United States Patent [19]

Wolters et al.

[11] 4,427,078

[45] Jan. 24, 1984

[54] PILE-DRIVING RAM

[75] Inventors: Henk R. Wolters, Delft; Paul Sillem, Rotterdam, both of Netherlands

[73] Assignee: De Rotterdamsche Droogdok MIJ B.V., Rotterdam, Netherlands

[21] Appl. No.: 252,209

[22] Filed: Apr. 8, 1981

[30] Foreign Application Priority Data

Apr. 8, 1980 [NL] Netherlands ..... 8002035

[51] Int. Cl.[3] ..... B25D 9/04

[52] U.S. Cl. ..... 173/126; 173/103; 173/139

[58] Field of Search ..... 173/102, 103, 126, 127, 173/139; 145/29 B

[56] References Cited

U.S. PATENT DOCUMENTS

| | | | |
|---|---|---|---|
| 2,812,745 | 11/1957 | Pyk | 173/127 |
| 3,245,482 | 4/1966 | Williams | 173/126 |
| 3,305,034 | 2/1967 | Koeln | 173/102 |
| 3,823,786 | 7/1974 | Voitsekhovsky | 173/126 |

FOREIGN PATENT DOCUMENTS

| | | | |
|---|---|---|---|
| 1175184 | 8/1964 | Fed. Rep. of Germany | 173/103 |
| 89450 | 2/1966 | France | 173/126 |

*Primary Examiner*—E. R. Kazenske
*Assistant Examiner*—James Wolfe
*Attorney, Agent, or Firm*—Oblon, Fisher, Spivak, McClelland & Maier

[57] ABSTRACT

A ram for driving elongated objects into the ground including a piston jacket, an anvil disposed on the object to be driven, a mechanism located within the jacket for directly impacting with the anvil and for reciprocating at least substantially in a direction of driving the elongated object during driving operation wherein the mechanism for impacting further includes a plurality of cup springs arranged in series in the direction of driving the object and which are in contact with one another and wherein a lowermost cup spring directly impacts the anvil during driving operation.

8 Claims, 1 Drawing Figure

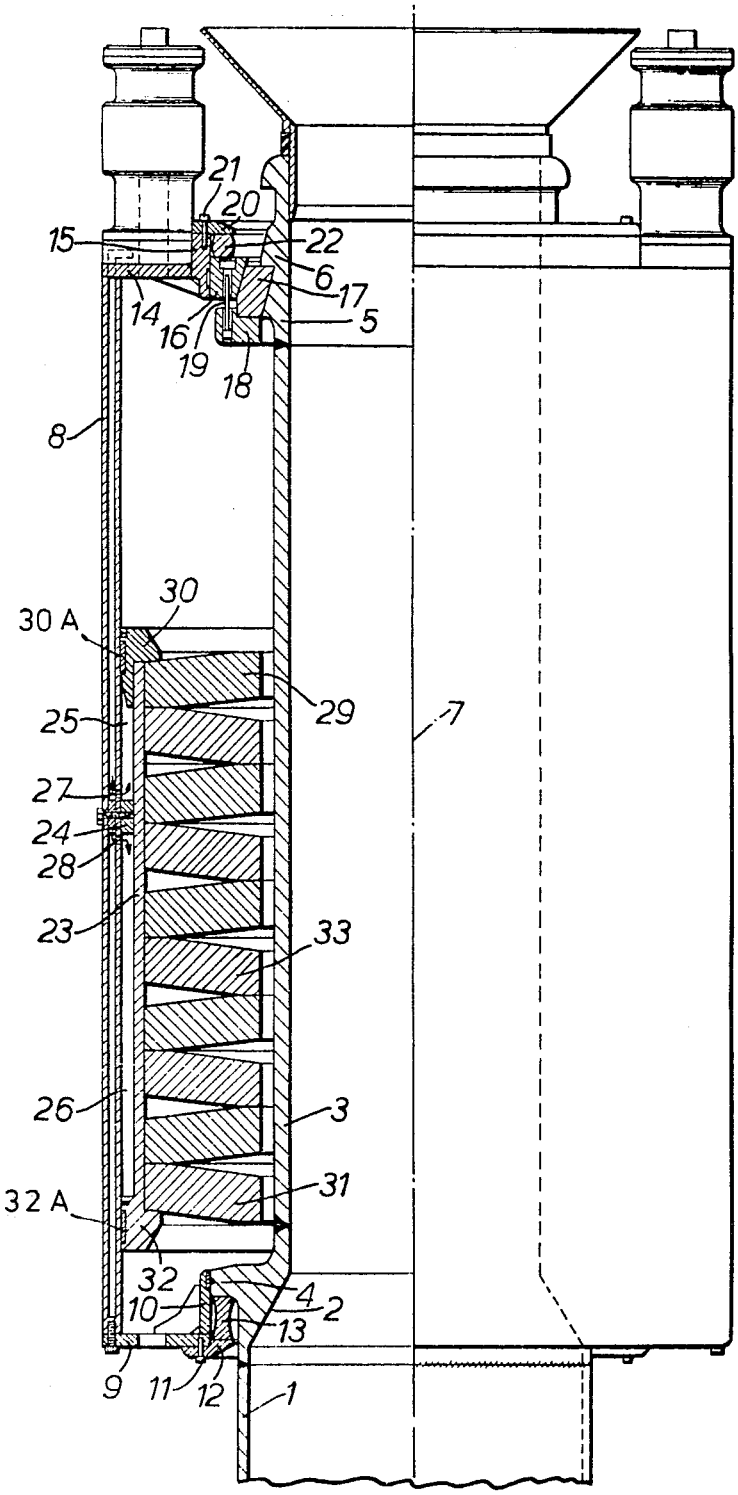
21
20
15
22
6
17
14
16
5
19
18
8
30
30 A
29
7
25
27
24
28
23
33
26
3
31
32 A
32
4
10
2
13
9
11
12
1

PILE-DRIVING RAM

BACKGROUND OF THE INVENTION

1. Field of the Invention

The invention relates to a pile-driving ram for driving elongated objects into the ground comprising an impact weight adapted to reciprocate at least mainly in the direction of displacement of the elongated object during operation and to cooperate with an anvil arranged on the object to be driven into the ground.

2. Description of the Prior Art

In the conventional pile-driving rams the impact weight is formed by a single mass which is lifted each time during operation over a given distance, after which said mass is allowed to drop freely and, as the case may be, the mass may even be accelerated during its fall so that the impact weight strikes the anvil cooperating with the object to be driven with a given speed. Upon collision particularly heavy forces are, in general, generated for a very short time. These forces are often markedly higher than the force required to overcome the resistance experienced by the object in the ground. Due to this impact characteristic the useful effect of the stroke, that is to say the penetration increment per stroke is not satisfying. Therefore, in many cases there is a tendency to use the highest possible striking speeds still allowed for reasons of strength. In many cases it can, however, not be avoided that in given parts of the ram and/or in the object to be driven into the ground for example, a pile, critical stress will occur, which is detrimental to the lifetime of the parts concerned and to the safety of operation of the pile-driving ram.

SUMMARY OF THE INVENTION

The invention has for its object to provide a pile-driving ram of the kind set forth, whilst the above-mentioned disadvantages can be avoided.

According to the invention this can be achieved in principle by composing the impact weight through a plurality of cup springs arranged one after the other viewed in the striking direction and in contact with one another, the lowermost one directly striking the anvil during operation.

By using the construction according to the invention the the impetus of the separate cup springs is transferred in order of time to the elongate object, for example, a pile, as a result of which the time period during which the force is exerted is relatively long. As a result, as compared with the conventional rams described above a higher useful effect of the impact, that is to say, a greater penetration increment per stroke is obtained by the same energy content of the stroke. Since in this case the lowermost cup spring directly strikes the anvil, the non-spring controlled mass may be minimized as a result of which the peak forces occurring at the beginning of the impact can be minimized as compared with the peak forces occurring in the conventional pile-driving ram. This will have an advantageous effect on the longevity of the various parts and the safety in operation and, moreover, the striking speed may be higher and hence higher impact energy may be used. By a suitable design of the cup springs themselves and by the composition of the spring packet the progress and/or the magnitude of the force can be varied in a simple manner so that the pile-driving ram can be simply adapted to the intended use.

It should be noted that U.S. Pat. No. 3,245,482 discloses a pile-driving ram formed by a plurality of metal blocks separated from one another by comparatively thin discs of slightly elastic material, for example, rubber. The various blocks are slipped onto a rod, one end of which is screwed into the lowermost block, whereas at the other end a nut is provided for clamping the further blocks and the interposed discs to the lowermost block. When such a ram is used, the initial peak of the impact force at the beginning of the stroke will, however, be as high as in the conventional ram mentioned above, which implies all drawbacks described above. Moreover, since the rod is rigidly fastened to the lowermost block, it will be directly loaded by said peak force, so that the risk of breakdown of said rod will be high.

From U.S. Pat. No. 2,812,745 is furthermore known the use of cup springs for striking tools. In this known construction the impact force is not directly transferred by a cup spring, but the stroke is transferred through a pin holding the packet of cup springs. When such a construction is employed, an initial peak of impact force occurs likewise, which is comparable with the initial peak occurring in the generally employed ram discussed above. The pin of the assembly of cup springs is directly loaded by said high peak force so that the risk of breakdown of this pin is very high.

Finally, from U.S. Pat. No. 3,823,786 is known an impact weight divided into a plurality of heavy metal discs arranged at a given distance from one another on a centrally disposed bolt, the connection between the discs and the bolt being established by a screw thread. Each disc is guarded on the bolt with the aid of a guard nut, which is elastically deformable to a given extent. Also in this construction the impact to be produced is directly transferred by the bolt so that the latter is adversely loaded. Apart therefrom, a dynamic parallel combination of the discs is utilized in contrast to the construction according to the present invention, in which the cup springs are connected in series. Therefore, when this known construction is employed, a different impact characteristic of shorter duration and higher peak forces are obtained than in the construction according to the invention.

BRIEF DESCRIPTION OF THE DRAWING

The invention will be described more fully hereinafter with reference to the accompanying FIGURE which schematically show a pile-driving ram according to the invention coupled with a pile to be driven into the ground.

The sole FIGURE shows a sectional view of that part of the combination of ram and pile to be driven into the ground which is located on one side of the center line.

DETAILED DESCRIPTION OF THE PREFERRED EMBODIMENTS

The pile to be driven into the ground comprises preferably a cylindrical tube 1, which is connected with the aid of an at least substantially tapering tie piece 2 with a tubing 3 of smaller diameter. The tie piece 2 is provided at the outer periphery with a protruding, circular collar 4, the outer diameter of which exceeds the outer diameter of the tube 1. At a distance above the collar or anvil 4 the tubing 3 is provided with two superimposed, protruding collars 5 and 6 having a more or less triangular section.

The ram comprising the above-noted elements coupled with the elongated object to be driven into the ground comprises a double-walled, cylindrical jacket 8 extending concentrically with the center line of the object, to the lower end of which jacket 8 is fastened an annular plate 9 at right angles to the center line 7.

To the inner edge of the annular plate 9 is fastened a ring 10 extending concentrically with the center line 7 and upwardly away from the annular plate 9. At the top end the inner wall of the ring 10 engages the outer periphery of the collar 4 in sealing relationship.

With the aid of bolts 11 a ring 12 is secured to the plate 9, the ring 12 being constructed so that part of the ring 12 extends inside the inner wall of the ring 9 in the direction of the tube 1. Between the part of the ring 12 extending above the inner ring 9 and the lower side of the collar 4 are arranged a plurality of buffers 13 of slightly resilient material, for example, rubber.

To the top end of the jacket 8 is also fastened an annular plate 14 at right angles to the center line 7. To the inner edge of the annular plate is secured a ring 15 extending concentrically with the center line 7. The ring 15 surrounds a ring 16 and its inner surface engages the outer periphery of the ring 16 in sealing relationship.

As will be seen in the FIGURE, the inner surface of the ring 16 is located in a conical plane, the center line of which coincides with the center line 7 of the tubing 3. The inner surface of the ring 16 is in contact with the outer periphery of a ring 17 and the inner surface of the ring 17 is in contact with the outer periphery of the nose 5.

The ring 17 bears by its lower end on a ring 18, which is suspended by means of bolts 19 to the ring 16. It will be obvious that by tightening the bolts 19 the rings 16 and 17 can be satisfactorily clamped tightly around the outer periphery of the elongated object.

To the top side of the annular plate 14 is furthermore fastened an annular plate 20 with the aid of bolts 21. Between the plate 20 and the subjacent ring 16 are arranged a plurality of buffers 22, for example made from rubber or similar material. It will be obvious that the jacket 8 is thus retained in the correct position around the tubing 3, whilst by depressing or elongating the buffers 13 and 22 respectively a small axial displacement of the jacket 8 can be carried out in the direction of length of the tubing 3.

The jacket 8 constitutes a cylinder in which an impact piston or piston jacket 23 is displaceable. The impact piston 23 is only by its ends in contact with the inner wall of the jacket 8 so that along the larger part of the length of the impact piston and the impact piston an annular gap is formed which is divided into spaces 25 and 26 by a ring 24 secured to the jacket 8. A seal between the ends of the piston jacket and the edge of the jacket is obtained with the aid of sealing members 30A and 32A, for example, piston rings arranged in the ends of the piston jacket 23.

To the space 25 can be fed and from it can be drawn a fluid such as air through the interior of the double-walled jacket 8 and a passage 27 located just above the ring 24, whereas pressurized air can be fed to and conducted away from the space 26 below the ring 24 through a passage 28 in the interior of the jacket 8.

Near the top end of the piston jacket 23 is arranged a ring 29 forming part of the impact weight and bridging partially the space between the inner circumference of the piston 23 and the outer circumference of the tubing 3 and being in contact with an internally protruding nose 30 of the impact piston.

A ring 31 forming a similar part of the impact weight bears on an internally protruding nose 32 located near the lower end of the impact piston 23 and forming part of said impact piston 23. Between the rings 29 and 31 are arranged a plurality of rings 33 also forming part of the impact weight. From the sole FIGURE it will be apparent that the rings are slightly conical like cup springs so that near the inner circumference each of these rings is in contact with one neighbouring ring and near its outer circumference with the other neighbouring ring. In fact, in the embodiment shown the larger part of the impact weight of the ram is divided among ten rings, but it will be obvious that, if desired, more or fewer rings of the same size or masses or of different sizes may be employed.

For driving the elongated object, the ram will be actuated by first feeding pressurized air through the passage 27 into the space 25 as a result of which the piston jacket 23 with the rings 29, 31 and 33 contained therein is moved upwardly. When the total impact weight formed by the piston jacket and the rings has reached its topmost position, the pressure in the space 25 is eliminated so that the impact weight can drop down. If desired, this movement of the impact weight may be accelerated by admitting pressurized air through the passage 28 into the space 26. When the impact weight moves downwards, first the lower ring 31 will collide with the collar 4 forming an anvil of the elongate object to be driven into the ground and subsequently, in order of succession the ring 33 and the rings 29 will transfer their movement impulse in timely order, whilst owing to the structure of the rings of the impact weight these parts will become compressed. In order to minimize wear during this compression the contact faces between the aforementioned parts are constructed so that the parts roll one along the other at the contact areas.

Thus the outermost contact points between the rings, can, if so desired, be positioned nearer the inner contact points of the springs to that at the compression of the cup springs owing to an impact a progressive increase in spring force is obtained as a result of which at the increase in striking speed of the impact weight to the anvil the average impact force will also progressively increase.

It has been found that by using the construction according to the invention the occurrence of a transient high peak of the impact force is avoided, whereas the impact force is maintained at a comparatively higher value for a longer period of time, said value lying largely below the peak value occurring in the conventional rams with rigid impact weights. The magnitude of the impact force in the course of time may be varied by selecting the size of the separate parts and the spring characteristics of these parts. It is, for example, possible to raise the magnitude of the impact force at the beginning slightly above the magnitude during the remaining part of the stroke. By a suitable supply of fluid it can be ensured that the upper ring 29 of the impact weight strikes the ring 18 then operating as an anvil, for example, in withdrawing a dam wall with the aid of the ram. It will be obvious that with this operation of the ram the same advantages are obtained as in normal pile driving.

The invention has been discussed herein with reference to an embodiment in which the ram is rigidly coupled with the object to be driven into the ground formed by a steel tube jacket in which after the insertion into the ground a concrete pile is formed, after which the tubular jacket is removed out of the ground by reversing the operation of the impact member in a manner such that with the aid of the impact member the tubular jacket 1 is struck out of the ground. As a matter of course, the invention may as well be applied to other types of pile-driving rams, for example, steam hammers, Diesel hammers and hydraulic hammers. The ram may be utilized for driving any kind of elongate objects such as pipes, piles, dam walls and so on into the ground. In such a case the lowermost anvil may be loosely deposited on the object to be driven or it may be releasably fastened thereto.

What is claimed as new and desired to be secured by Letters Patent of the United States is:

1. A ram for driving elongated objects into and out of the ground comprising:

a piston jacket;

a cylinder jacket co-axially arranged with respect to said piston jacket and forming a space therebetween;

an anvil disposed near one end of said ram;

means guided by said piston jacket for directly impacting with said anvil and for reciprocating at least substantially in a direction of driving displacement of the elongated object during driving operation wherein said means for impacting further comprises a plurality of cup springs arranged in series in the direction of driving said object and which are in contact with one another wherein an outermost cup spring of said plurality of cup springs directly impacts said anvil during driving operation;

first and second sealing members located at opposite end portions of said piston jacket for cooperative engagement with a facing wall portion of the cylinder jacket;

a ring positioned between said first and second sealing members, fastened to the cylinder jacket slidably contacting the piston jacket and dividing said space between the piston jacket and the cylinder jackets in two parts;

means for introducing pressurized fluid beneath and above the ring into said space formed between the cylinder jacket and the piston jacket.

2. A ram as claimed in claim 1 wherein said cup springs each further comprise contact faces and wherein upon deformation of the cup springs during driving operation the contact faces of the cup springs roll over relative to one another.

3. A ram as claimed in claim 1 or 2, wherein said cup springs have contact surfaces such that, upon depression of the cup springs contact points between the cup springs shift towards one another in a radial direction.

4. A ram as claimed in claim 1 wherein the mass of at least some of said cup springs differs from a mass of the remaining cup springs.

5. A ram as claimed in claim 1, wherein said anvil further comprises a first and second anvil and wherein said first anvil is connected to said second anvil and said second anvil is located above said cup springs and wherein a topmost cup spring of said cup springs is directly cooperatively engageable with said second anvil.

6. A ram as claimed in claim 5, further comprising a tubing member co-axially arranged with respect to said piston jacket and said cup springs and interconnecting the first anvil and second anvil.

7. A ram as claimed in claim 5, further comprising first and second buffer means disposed on opposite sides of the first and second anvil, respectively, for supporting the cylinder jacket.

8. A ram as claimed in claim 1, further comprising a first and second stop member located in opposite end portions of said piston jacket and surrounding said cup springs wherein said cup springs are locked between said first and second stop members.

* * * * *